United States Patent [19]

Hojas et al.

[11] 4,287,738

[45] Sep. 8, 1981

[54] METHOD OF CONTROLLING THE CONTINUOUS MOVEMENT OF STOCK BEING ROLLED IN A ROLLING MILL TRAIN

[75] Inventors: Hans Hojas; Alois Leutgöb, both of Steyr; Johann Gsottbauer, St. Martin, all of Austria

[73] Assignee: GFM Gesellschaft fur Fertigungstechnik und Maschinenbau Gesellschaft m.b.H., Steyr, Austria

[21] Appl. No.: 96,040

[22] Filed: Nov. 20, 1979

[30] Foreign Application Priority Data

Dec. 18, 1978 [AT] Austria ..... 9003/78

[51] Int. Cl.[3] ..... B21B 37/00; B21D 5/14

[52] U.S. Cl. ..... 72/20; 72/177; 72/234

[58] Field of Search ..... 72/20, 245, 181, 177, 72/249, 234; 226/7

[56] References Cited

U.S. PATENT DOCUMENTS 2,363,585 11/1944 Grosser et al. ..... 72/28

4,079,615 3/1978 Noe ..... 72/205

*Primary Examiner*—Milton S. Mehr

*Attorney, Agent, or Firm*—Kurt Kelman

[57] ABSTRACT

The rolls of each rolling mill stand of a rolling mill train are driven by a hydraulic turbine. A variable displacement pump is operated to apply hydraulic pressure to each of said turbines to operate the same at an infinitely variable speed. Any change of said hydraulic pressure applied to the turbine which drives a preceding one of said stands in response to the initial passing of the stock through a succeeding one of said stands is detected. The displacement of the variable displacement pump which operates the turbine which drives said succeeding stand is adjusted to correct the speed of the turbine which drives said succeeding stand to compensate the change of the hydraulic pressure which has thus been detected.

3 Claims, 5 Drawing Figures

Figure 1:
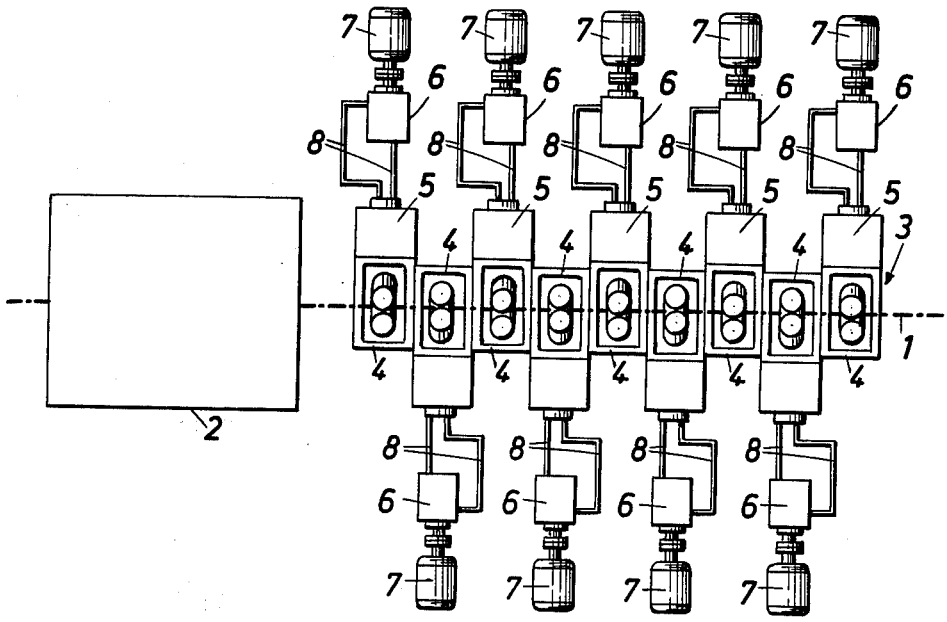

METHOD OF CONTROLLING THE CONTINUOUS MOVEMENT OF STOCK BEING ROLLED IN A ROLLING MILL TRAIN

This invention relates to a method of controlling the continuous movement of stock being rolled in a rolling mill train in which each rolling mill stand is provided with a drive unit which is operable at an infinitely variable speed to drive the rolls of said stand, wherein a physical parameter which varies with the shaping torque exerted by each preceding rolling mill stand is measured before and after the initial passing of the stock through the succeeding rolling mill stand and the speed of the drive unit associated with said succeeding stand is controlled in dependence on any change of said parameter which has been detected as a as a result of said initial passing.

It is known that elongated continuous workpiece can be swaged and subsequently rolled in a sequence of operations in which the main deformation is effected by a continuous swaging machine and the stock is subsequently profiled and sized in a succeeding rolling mill train. Such deformation in two stages affords the special advantage that a high surface finish is obtained and the workpieces can be shaped to close tolerances. If the rolling mill train is desired to effect not only a sizing of the stock but a further reduction in any desired number of rolling mill stands which succeed the swaging machine, the close tolerances and the surface finish which are desired can be obtained only if the stock is not pulled or restrained as it is rolled.

It is known that the movement of stock being rolled can be automatically controlled so that the stock is not pulled or restrained as it is rolled if the stock being rolled is deflected in the form of loops between the rolling mill stands. In that case the speed of the rolls of the rolling mill stand which succeeds the loop is automatically controlled so that the height of the loop is maintained within a certain range. For this reason, the rolling mill stands of trains arranged for loop control must be spaced relatively large distances apart and the deflecting force required for the formation of a loop is very strong if the stock being rolled is thick. Another disadvantage of such loop control resides in that it cannot be used in the rolling of profiled stock and for this reason cannot be adopted for rolling profiled bar stock without pulling or restraining the stock.

If the loop control is replaced by an automatic speed control in dependence on the power input of each preceding rolling mill stand, the distance between adjacent rolling mill stands need not be as large as with loop control but the automatic control cannot be effected with the accuracy which is required to ensure that the desired tolerance limits will be adhered to. For a rolling without pulling or restraining the stock, the shaping torque which is required for the reduction in each rolling mill stand must be exerted by said rolling mill stand. The actual shaping torque exerted by a rolling mill stand cannot be measured directly. Because the power input of a rolling mill stand will be changed as the stock passes through the next following stand if the latter exerts pulling or restraining forces on the stock, a measurement of the power input of the preceding rolling mill stand before and after the initial passing of the stock through the succeeding rolling mill stand will indicate whether said succeeding stand exerts substantially only the torque which is required to deform the stock or whether additional forces are exerted on the stock in said succeeding stand and require the speed of the rolls of said stand to be changed so that the stock being rolled will be free from longitudinal stresses. It must be borne in mind that the pulling or restraining force exerted on the stock being rolled is primarily related to the actual shaping torque rather than to the power change so that the volume which is deformed per unit of time ought also to be known for a sufficiently accurate control of the movement of the stock. That the additional parameter cannot be measured because this would require that the velocity of the stock is measured for each cross-section thereof. For this reason control effected in dependence on a measurement of the power input or power input change and intended to ensure a low-pull or low-restraint rolling is necessarily inaccurate and cannot ensure that close tolerances will be adhered to. Besides, even though the power can be measured in a simple manner with the usual d.c. motor drives, a high expenditure is required to compute the required correction of the succeeding rolling mill stand in dependence on the detected power change of the preceding stand.

Whereas the actual shaping torque cannot be measured directly the rolling forces exerted in each stand after the initial passing of the stock being rolled can be measured and the actual shaping torque can be computed from said rolling forces if the resistance to deformation is known. This practice involves a high computing expenditure and it is hardly possible to measure said resistance to deformation so that this control has also a basic disadvantage which adversely affects the accuracy of the control.

It is an object of the invention to avoid these disadvantages and to provide control of the continuous movement of stock being rolled in a rolling mill train an improved method which requires only simple means and a low expenditure and ensures that the stock being rolled will not be pulled or restrained.

This object is accomplished in that each drive unit comprises a hydraulic turbine, which is operated by a variable displacement pump, that the parameter which is measured is the hydraulic pressure applied to the hydraulic turbine which drives each preceding rolling mill stand and that in case of a detection of a change of said hydraulic pressure after the initial passing of the stock through the succeeding rolling mill stand the pump associated with the hydraulic turbine which drives said succeeding rolling mill stand is controlled to correct the speed of the hydraulic turbine which drives said succeeding rolling mill stand in a sense to compensate the change of the hydraulic pressure applied to the hydraulic turbine which drives the preceding rolling mill stand. Because there is a simple relationship between the torque exerted by a hydraulic turbine and the hydraulic pressure applied, the torque can be directly computed from the measured hydraulic pressure and a change of the hydraulic pressure in response to the initial passing of the stock through the succeeding stand will directly indicate whether or not the succeeding stand pulls or restrains the stock. It is permissible to assume that those torque loads which are applied to each drive unit in addition to the shaping torque are constant within an adequate accuracy.

When a change of the hydraulic pressure applied to the drive unit for a given stand is detected in response to the initial passing of the stock through the succeeding stand, the speed change required in the succeeding stand for rolling without pulling or restraining can be directly determined from the torque-speed characteristic, which can easily be determined by measurement, or from the proportional pressure-speed characteristic, and the speed can be changed in a simple manner by a change of the displacement of the variable displacement pump.

It is apparent that the use of hydraulic drive units, known per se, permits the actual shaping torque to be determined directly in dependence on the hydraulic pressure, which can easily be measured, so that in dependence on the change of the hydraulic pressure related to the proportional torque change resulting from the initial passing of the stock through the succeeding stand the speed of the succeeding stand can be adjusted so that said succeeding stand exerts exactly the desired shaping torque.

The corrected speed value for each succeeding stand corresponding to a constant hydraulic pressure applied to the drive unit of the preceding stand may be stored and in a new rolling operation each stand may be initially operated at said corrected speed so that only a very small correction will be required.

Figure 2:
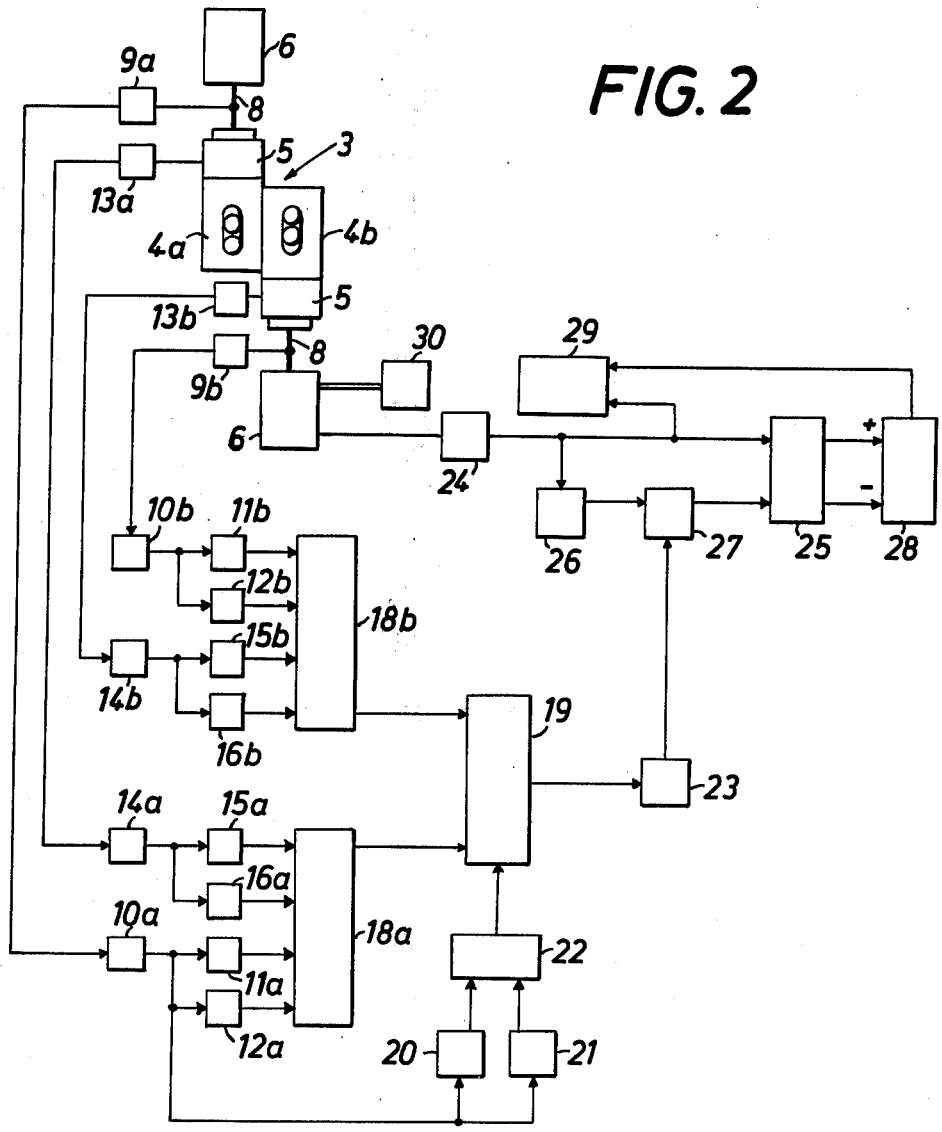
Figure 3:
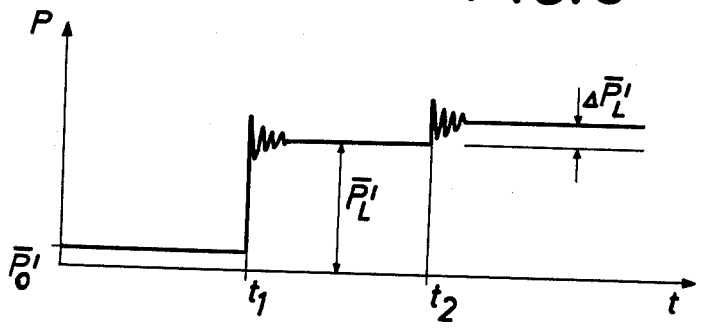
Figure 4:
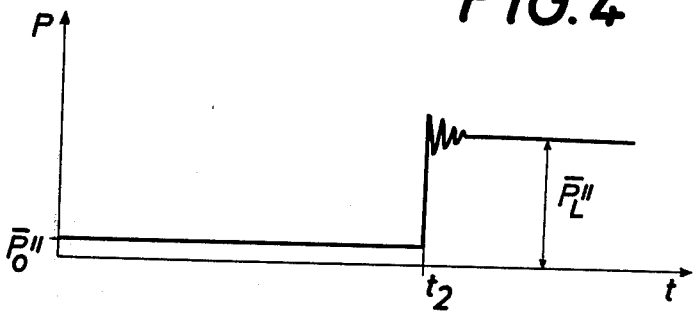
Figure 5:
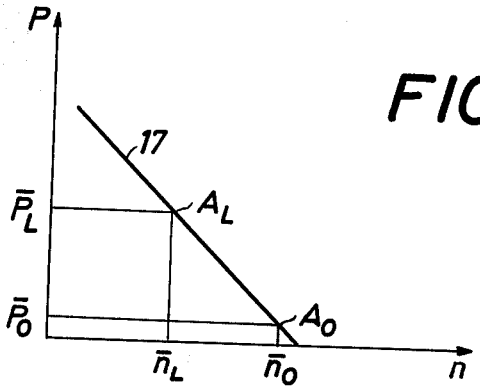

The method according to the invention will be explained more in detail with references to the accompanying drawings, in which FIG. 1 is a top plan view showing a rolling mill train which succeeds a continuous swaging machine, FIG. 2 is a simplified block diagram showing a system for controlling the rolling mill train, FIG. 3 is a diagram showing the change of the hydraulic pressure applied to the hydraulic turbine of the first rolling mill stand in dependence on time, FIG. 4 is a diagram similar to FIG. 3 and shows the change of the hydraulic pressure applied to the hydraulic turbine for the second rolling mill stand in dependence on time and FIG. 5 shows the speed-hydraulic pressure characteristic of a rolling mill stand.

The elongated workpiece 1 is shaped in a continuous swaging machine 2 and is then supplied to a rolling mill train 3, in which the stock is reduced in excess of the reduction which would be required for sizing. To ensure that the close tolerances which are required can be adhered to in this relatively large reduction, the stock being rolled must be moved so that it is rolled without being pulled or restrained. For this purpose, each rolling mill stand 4 of the rolling mill train is driven by a drive unit at an infinitely variable speed. Each drive unit comprises a hydraulic turbine 5 and a variable displacement pump 6, which is connected to the turbine 5 and driven by an electric motor 7. The hydraulic conduits between the pump 6 and the hydraulic turbine 5 are designated 8.

As is apparent from FIG. 2, the hydraulic pressure applied to the drive unit for the first rolling mill stand **4*a* is sensed by a transducer 9*a*, which delivers a corresponding signal to an averager 10*a*, which supplies two memories 11*a* and 12*a* with a signal which represents the average hydraulic pressure during a predetermined time. The speed of the hydraulic drive unit for the stand 4*a* is also sensed by a transducer 13*a* and a signal corresponding to the average speed is written by an averager 14*a* into two memories 15*a* and 16*a*. The writing into the memories 11*a*, 12*a*, 15*a* and 16*a* is effected in dependence on the movement of the stock being rolled and is controlled by an overriding sequence controller, which is not shown for the sake of clearness. The average values ascertained for the first stand 4*a* before the initial passing of the stock are written into the memories 11*a* and 15*a* and the average values ascertained after the initial passing of the stock are written into the memories 12*a* and 16*a*. In this way, the average speed $\bar{n}_o$ and the average pressure $\bar{P}_o$ for no-load operation under the average speed $\bar{n}_L$ and the average pressure $\bar{P}_L$ for operation under load are stored. From these values, the speed-hydraulic pressure characteristic can be determined in the manner shown in FIG. 5. The speed values n plotted along the abscissa of the system of coordinates in conjunction with the pressure values P plotted along the ordinate define two operating points $A_o$ and $A_L$, which define the characteristic 17. When the operating point $A_L$ has changed, the speed correction which is required to reach the original operating point $A_L$ for the different pressure which has been measured can be directly read from the characteristic 17**.

The change of the average hydraulic pressure applied before and after the initial passing of the stock through the rolling mill stand **4*a* is a good indication of the pressure change which results from said initial passing. That pressure change is proportional to the average shaping torque that has been exerted. FIG. 3** indicates the pressure rise from $\bar{P}_o'$, to $\bar{P}_L'$ at the time $t_1$ of the initial passing. It will be understood that there will be a transient before the value $\bar{P}_L'$ is maintained.

In a characteristic computer **18*a*, which is connected to the memories 11*a*, 12*a* and 15*a*, 16*a*, the relationship between speed and hydraulic pressure represented in FIG. 5** can be computed from the stored values $\bar{n}_o'$, $\bar{P}_o'$ and $\bar{n}_L'$, $\bar{P}_L'$. It can be assumed that the relationship is linear to an adequate accuracy at least near the operating points.

The average speeds and average pressures for each succeeding rolling mill stand are similarly ascertained and stored. This is shown in FIG. 2 for the second rolling mill stand **4*b*. In FIG. 2**, similar means are designated with the same reference numbers but with the suffix b for the second rolling mill stand.

To ensure a rolling in the absence of pulling and restraining forces, the shaping torque exerted by the preceding rolling mill stand must not be changed by the initial passing of the stock through the succeeding stand because only in that case will the torque exerted by the succeeding rolling mill stand be just sufficient to effect the desired shaping of the stock. For this reason, the monitoring of the shaping torque exerted by a preceding rolling mill stand will indicate whether or not pulling or restraining forces are exerted by the succeeding rolling mill stand. When it is found that the hydraulic pressure applied to the drive unit for the first rolling mill stand **4*a* is changed at the time $t_2$ (FIG. 4) of the initial passing of the stock through the second rolling mill stand 4*b*, the drive unit for the second rolling mill stand 4*b* must be correspondingly adjusted. The method according to the invention is based on the recognition that there is a simple relationship between the shaping torque exerted by each rolling mill stand and the hydraulic pressure applied to the associated hydraulic drive unit so that the required speed change of the second rolling mill stand 4*b* can be derived from the also simple relationship between hydraulic pressure and speed. In the example shown, the initial passing of the stock through the second rolling mill stand 4*b* causes the hydraulic pressure applied to the associated drive unit to rise from the no-load value $\bar{P}_o''$ to $\bar{P}_L''$ and the increase of the average shaping torque exerted by the rolling mill stand 4*b* in proportion with the average pressure $\overline{P}_L''$ result in an increase of the shaping torque exerted by the first rolling mill stand 4***a* corresponding to an increase of the average hydraulic pressure applied to the associated hydraulic drive unit. This pressure rise indicates that the shaping torque exerted by the second rolling mill stand is inadequate and the speed of the drive unit for that stand must be increased. As the several rolling mill stands usually have different speed-hydraulic pressure characteristics, the required speed change cannot be directly ascertained from the characteristic of the first rolling mill stand 4*a*. For this reason, factors representing the relationship between pressure and speed for each of the stands 4*a* and 4*b* are delivered to another computer 19, in which the relationship of the speed of the second stand 4*b* to the hydraulic pressure applied to the drive unit of the preceding stand 4*a* is computed from said factors. It is recalled that the relationship between the pressure and the speed for each of the stands 4*a* and 4*b* has been ascertained in the characteristic computer 18*a* or 18*b*, respectively. It is apparent that it is relatively easy to compute the relationship between the speed of the second stand 4*b* and the hydraulic pressure applied to the drive unit for the preceding stand 4*a* and that it is possible to ascertain from this relationship the speed change which is required in the second stand 4*b* to return the hydraulic pressure applied to the drive unit of the preceding rolling mill stand 4*a* to the value of the pressure applied before the initial passing of the stock through the second rolling mill stand. To that end, the pressure change $\Delta\overline{P}_L'$ which is due to the initial passing through the second rolling mill stand 4*b* is ascertained. For this purpose the averager 10*a* is succeeded by two memories 20 and 21, in which the average pressure values ascertained before and after the initial passing of the stock through the rolling mill stand 4*b* are stored. The pressure change $\Delta\overline{P}_L'$ is ascertained by an averager 22, which delivers a corresponding signal to the computer 19, which then computes the required speed change for the second rolling mill stand 4*b* in consideration of the pressure-speed relationship which has been ascertained.

Because the pump 6 in the embodiment shown by way of example consists of a reciprocating piston pump, the speed of the hydraulic turbine 5 is desirably controlled by a variation of the stroke of the pump. This is accomplished by an adjustment of the inclination of the swash plate of the pump 6. For this reason the required speed change which has been computed must be converted into a change of the inclination of the swash plate. As the relationship between these parameters is known, a multiplier 23 which is fed with the required pump data can be used to convert the required speed change into a corresponding adjustment of the inclination of the swash plate.

For the control of the reciprocating piston pump 6 the actual inclination of the swash plate is sensed by a transducer 24, which delivers a corresponding signal to one input of a comparator 25. The desired value of said inclination is delivered to the second input of the comparator 25 and is computed from the inclination corresponding to the no-load speed, which inclination has been ascertained before the initial passing, and the correcting angle which is derived from the speed change relative to the no-load speed. That speed change has been computed by the computer 19. The inclination of the swash plate of the pump 6 is measured under lo-load conditions and is stored in a memory and is corrected by the computed change after the initial passing of the stock through the rolling mill stand 4*b*. For this purpose the memory 26 and the multiplier 23 are connected to the inputs of an analog adder 27, which is connected to the comparator 25. Because proper signs are associated with the speed changes computed for the rolling mill stand 4*b*, the desired value of the inclination of the swash plate of the pump 6 is actually available for the comparator.

In dependence on the difference between the desired and actual values, the comparator 25 delivers pulses in a number corresponding to said difference to a counter 28. A signal corresponding to the count of the counter 28 is delivered to an operational amplifier 29. The signal which corresponds to the actual inclination is also delivered to the operational amplifier 29, which in dependence on said actual-value signal and the signal representing the count of the counter 28 causes the displacement control means 30 for the pump to effect a preferably hydraulic adjustment of the inclination of the swash plate. It is apparent that the pump is controlled by a feedback control system which compensates variations which are due to the operation and ensures that the shaping torque which is exerted agrees with the desired shaping torque.

It is apparent that the method according to the invention permits a simple control of the drive unit for the several rolling mill stands so that a rolling operation without pulling and restraining is ensured.

What is claimed is:

1. A method of controlling the continuous movement of stock to be rolled through a series of rolling mill stands, comprising driving the rolls of each of said stands by a hydraulic turbine, operating a variable displacement pump to apply hydraulic pressure to each of said turbines to operate the same at an infinitely variable speed, detecting any change of said hydraulic pressure applied to the turbine which drives a preceding one of said stands in response to the initial passing of said stock through the succeeding one of said stands, and adjusting the displacement of the variable displacement pump which operates the turbine which drives said succeeding stand to correct the speed of the turbine which drives said succeeding stand to compensate the change of the hydraulic pressure which has thus been detected.

2. A method as set forth in claim 1, in which the amount to which the speed of the turbine which drives said succeeding stand is corrected is determined in dependence on the relationship between said speed and the hydraulic pressure applied to the hydraulic turbine which drives the preceding stand.

3. A method as set forth in claim 1, in which the value to which the speed of each turbine which drives a succeeding stand has been corrected in a given rolling operation is stored and each turbine which drives a succeeding stand is initially operated at a speed corresponding to said stored value for a succeeding rolling operation.

* * * * *